United States Patent [19]

Bustos

[11] 4,063,518

[45] Dec. 20, 1977

[54] SHELF STRUCTURE FOR A DISPLAY RACK

[75] Inventor: Rafael T. Bustos, Clarkston, Ga.

[73] Assignee: Leggett & Platt, Incorporated, Carthage, Mo.

[21] Appl. No.: 671,084

[22] Filed: Mar. 29, 1976

[51] Int. Cl.[2] ..... A47B 11/00

[52] U.S. Cl. ..... 108/6; 108/137

[58] Field of Search ..... 108/1, 2, 3, 4, 5, 133, 108/148, 107, 137; 312/348; 211/187

[56] References Cited

U.S. PATENT DOCUMENTS

| | | | |
|---|---|---|---|
| 1,876,172 | 9/1932 | Ruddy | 108/6 |
| 3,040,904 | 6/1962 | St. Amour | 108/1 |
| 3,120,199 | 2/1964 | Kolster | 108/6 |
| 3,666,337 | 5/1972 | Sztorc | 312/348 X |
| 3,955,511 | 5/1976 | Bak | 108/137 |

FOREIGN PATENT DOCUMENTS

| | | | |
|---|---|---|---|
| 216,317 | 11/1956 | Australia | 211/187 |
| 1,328,743 | 4/1963 | France | 108/1 |

*Primary Examiner*—James T. McCall
*Attorney, Agent, or Firm*—Wood, Herron & Evans

[57] ABSTRACT

A novel shelf structure for a display rack. The shelf structure is movable in its support plane between an extended position and a retracted position to vary the shelf area exposed for merchandise support. The shelf structure also is positionable in either a horizontal display position or a rearward tilt display position as selected by the user of the display rack. The shelf itself includes a front section and a rear section, the front section being telescopible into and out of the rear section to establish the desired merchandise support area. Both shelf sections are carried on a pair of arms pivotally connected to opposed side frames of the display rack, the pivot axis of the arms being adjacent the front face of the display rack, to permit positioning of the shelf in either the horizontal or rearward tilt attitudes for merchandise display.

7 Claims, 11 Drawing Figures

SHELF STRUCTURE FOR A DISPLAY RACK

This invention relates to display racks. More particularly, this invention relates to a novel shelf structure for display racks.

Display racks are often used in supermarkets, as well as other types of stores, to display items of merchandise generally handled as self-service items. For example, such a display rack is often used to display cases or cartons of soft drink bottles in supermarkets, the bottles being removable by the customer in a self-service manner from the display rack.

In connection with such display racks, in certain commercial situations it has been found desirable to provide the display rack with a shelf structure which is adjustable in a planar fashion so as to vary the merchandise support or surface area provide for the self-service items. In other words, it is desirable that the merchandise support area be variable by the store, that shelf area exposed being dependent upon the popularity of the merchandise to the store's customers, as well as upon the inventory of the merchandise on hand. With a lower popularity or lower inventory for the product, the merchandise support area of the shelf structure might be adjusted, i.e., retracted, to provide the minimum such area. However, with a very popular product (for example, soft drinks), the merchandise support area of the shelf structure might be adjusted, i.e., extended, to provide a maximum exposed area.

In addition, it has been found desirable to provide a display rack with a shelf structure which is selectively positionable in either a substantially horizontal merchandise display attitude or a rearwardly tilted or angulated merchandise display attitude. Such might be desirable, for example, in supermarket sales of soft drinks in the six-bottle or six-can cartons because such merchandise cartons are stacked one on top the other on the shelf. A rearward tilt for the soft drink packages exposes the labeling on the packages' front face in a more visible manner to the consumer, particularly if the shelf is located at floor level, i.e., is the base shelf of the display rack.

Also important in connection with such display racks, in present day merchandising practices, is the attractiveness or appearance of the rack. It is desirable that the display rack be of neat and attractive appearance so as to not offend the customer from an aesthetic standpoint.

Therefore, it has been one objective of this invention to provide a display rack having a novel shelf structure that includes at least one shelf selectively positionable at either a substantially horizontal display attitude or a tilting display attitude, the merchandise display attitude selected being dependent on the desire of the user.

It has been another objective of this invention to provide a display rack having a novel shelf structure that permits the merchandise support area of that shelf structure to be varied between maximum and minimum area positions by providing a front shelf section that is telescopible relative to a rear shelf section.

It has been a further objective of this invention to provide a novel shelf structure for display racks, that shelf structure being selectively positionable at either a substantially horizontal display attitude or a tilting display attitude, and that shelf structure being adjustable to vary the merchandise support area of the shelf structure between maxiumum and minimum positions.

In accord with these objectives, the novel shelf structure of this invention, in preferred form, is movable in its support plane between an extended position and a retracted position to vary the shelf area exposed for merchandise support. The shelf structure also is positionable in either a horizontal display position or a rearward tilt display position as selected by the user of the display rack. The shelf itself includes a front section and a rear section, the front section being telescopible into and out of the rear section to establish the desired merchandise support area. Both shelf sections are carried on a pair of arms pivotally connected to opposed side frames of the display rack, the pivot axis of the arms being adjacent the front face of the display rack, to permit positioning of the shelf in either the horizontal or rearward tilt attitudes for merchandise display.

Other objectives and advantages of this invention will be more apparent from the following detailed description taken in conjunction with the drawings in which.

Figure 1:
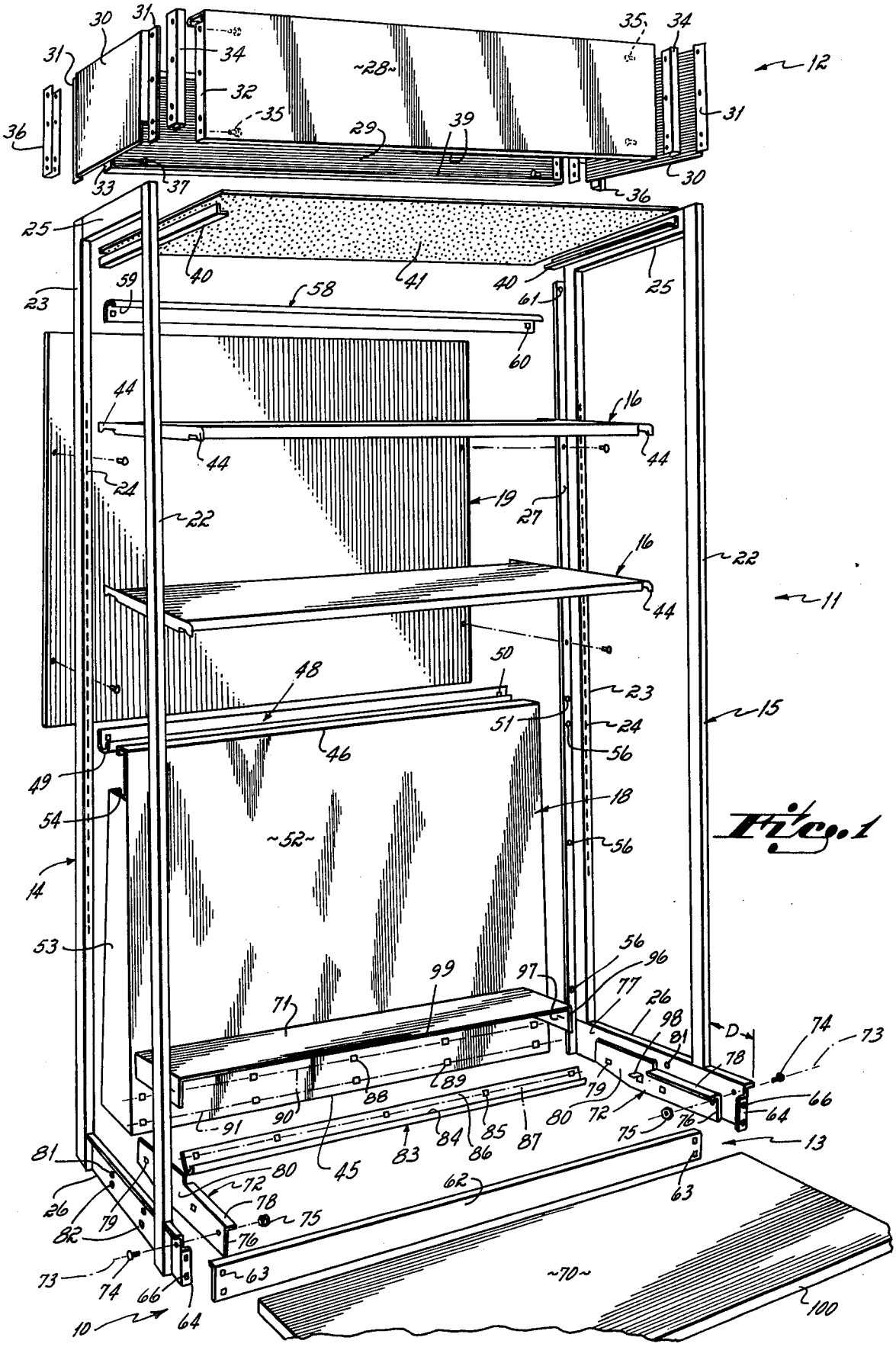
FIG. 1 is an exploded perspective view of a display rack in accord with the principles of this invention.

The novel shelf structure 10 of this invention is illustrated in combination with a display rack 11 as shown in FIG. 1. The novel shelf structure 10 is illustrated as a bottom or floor shelf in the Figures, but it will be understood that same can be disposed intermediate the head 12 and foot 13 of the display rack 11 if desired. The display rack 11 illustrated in the Figures basically includes opposed stationary side frames 14, 15, the floor shelf structure 10 which is structured in accord with the principles of this invention, intermediate shelves 16, a header or top section 12, and back panels 18, 19.

Figure 8:
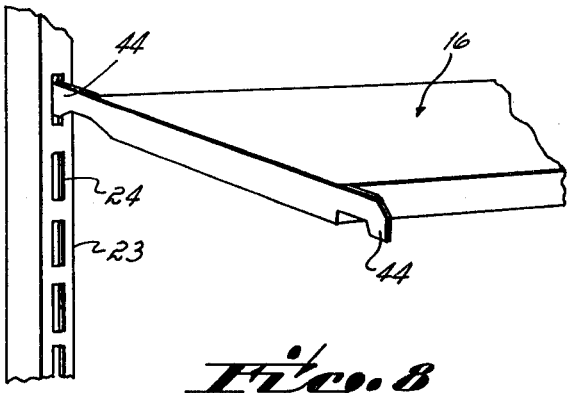
FIG. 8 is a fragmentary perspective view illustrating the mounting of the intermediate shelves on the display rack.

As shown in FIG. 1 each of the display rack's side frames 14, 15 includes a front post 22 and a rear post 23, the posts being provided with spaced vertical slots 24 along the length thereof for the mounting of intermediate shelves 16 as is described in detail below, see FIG. 8. Each side frame includes a head cross member 25 fixed at one end of the front post 22 and fixed at the other end to the rear post 23, and a foot cross member 26 also fixed at one end to the front post and at the other end to the rear post. Each of the foot frame members 26 extends forwardly from its respective front post 22 a distance D. Each of the rear posts 22 includes an inwardly turned flange 27, the flanges cooperating in the mounting of the upper 19 and lower 18 back panels in a manner described below.

Figure 3:
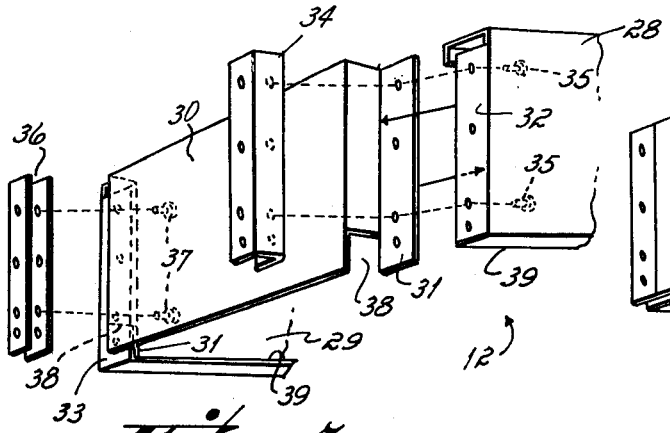
FIG. 3 is an exploded and partial view of the header for the display rack.
Figure 4:
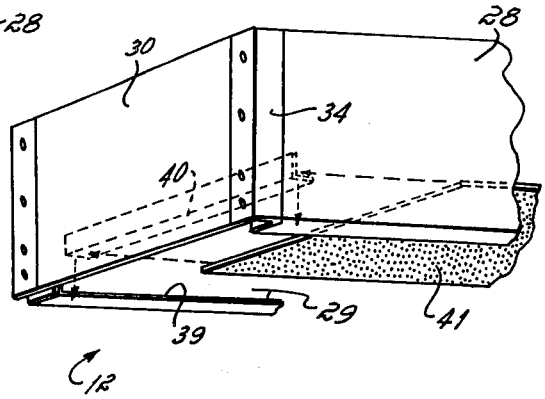
FIG. 4 is an assembled and partial view of the header for the display rack.
Figure 2:
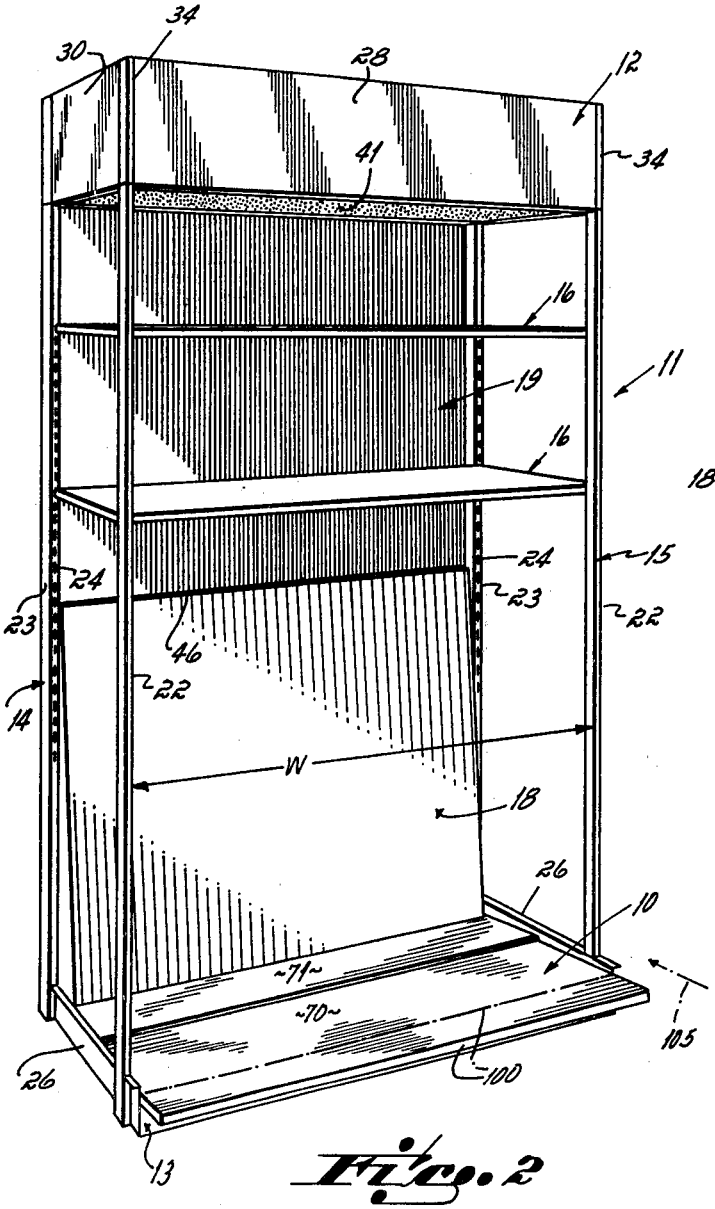
FIG. 2 is an assembled perspective view of the display rack shown in FIG. 1.

The header 12 of the display rack 11 interconnects the two side frames 14, 15 at the top of the display rack structure, see FIGS. 2–4. The header 12 basically includes front 28 and rear 29 head panels and opposed side head panels 30. Both side head panels 30, along each side edge thereof, are provided with right angle flanges 31, see FIGS. 1 and 3. The side head panel's flanges 31 are adapted to interfit with a straight flange 32 provided on an adjacent side edge of the front head panel 28, and a similar straight flange 33 provided on an adjacent side edge of the rear head panel 29. A channel shaped front head post 34 is located in the notched corners defined between the front head panel 28 and side panels at the corners thereof, i.e., at the front corners of the header 12, bolts 35 being provided to connect same together at the top and bottom thereof into a fixed unit. A channel shaped rear head post 36 is located at each rear corner of the header 17, same joining together the rear head panel 29 and the side head panels 30 with bolts 37 as illustrated. This header 17 structure, as illustrated in FIG. 3, includes corner notches 38 at each of the four corners thereof, those notches permitting the header to fit down over head cross members 25 of the side frames 14, 15 at the top thereof into structural relation therewith. Note, as illustrated in FIG. 4, that front and rear panels 28, 29 include a lip 39 extending inwardly therefrom adjacent the bottom edge of that panel. Ceiling supports which take the form of right angle members 40, sized and configured to fit inside the header 12 structure, are seated on those ceiling lips 39. A ceiling 41 rests on the lips 39 and angles 40.

Figure 5:
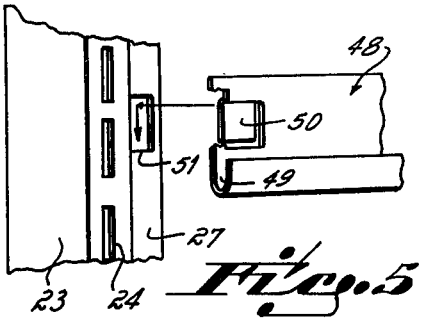
FIG. 5 is a fragmentary perspective view illustrating the mounting of the back plate retainer lip on the display rack.
Figure 6:
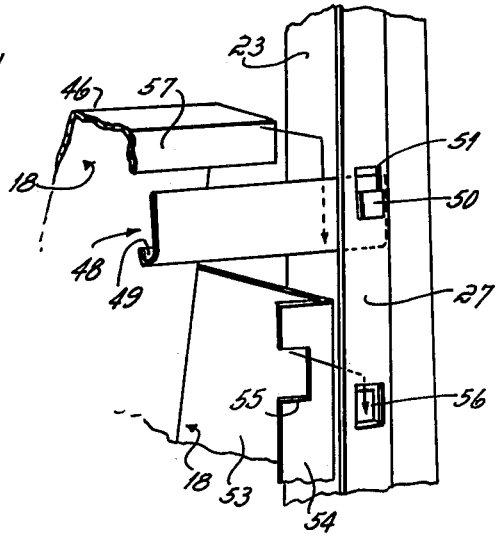
FIG. 6 is a fragmentary perspective view illustrating the manner in which the lower back panel is mounted to the back plate retainer lip on the display rack.

The display rack's upper back panel 19 is separate from its lower back panel 18, the upper back panel being vertically oriented and the lower back panel being angulated relative to vertical with its bottom edge 45 being located closer to the display rack's front posts 22 than its top edge 46, see FIGS. 1 and 2. The lower back panel 18 is fixed in place between side frames 14, 15 through use of lower back panel retainer lip 48 and the inwardly turned flanges 27 running along the length of each side frame's rear post 23, see FIG. 6. The lower back panel retainer lip is in the form of an elongated channel shaped member having an upwardly turned lip 49 along the bottom edge thereof, each end of that member being provided with a rearwardly, and downwardly opening tab 50 closely adjacent each end. The tabs 50 at each end of the lower back panel retainer lip 48 are seated in slots 51 disposed at the requisite height in each of the rear post's flanges 27, thereby locating the lower back panel retainer lip in the desired horizontal attitude above floor level, see FIG. 5. The lower back panel 18 itself is provided with a face portion 52, and opposed side wall portions 53 along each side thereof. The side wall portions 53 include inwardly turned flanges 54, each of those flanges being provided with a series of slots 55, see FIG. 6. These slots 55 are seated on upwardly and inwardly turned tabs 56 on each rear post's flange 27, and at the lower back panel's rearwardly turned lip 57 (which runs along the top edge of the lower back panel 18) and received in the lower back panel retainer lip 49, when the lower back panel 18 is structurally related to the side frames 14, 15 thereby locating the lower back panel in desired spatial relation with the side frames. This mounting means for the lower back panel 18 to the rear posts 23 of opposed side frames 14, 15 insures exact positioning of the lower back panel thereon and insures the structural integrity of the display rack 11 once same is completely erected.

Figure 7:
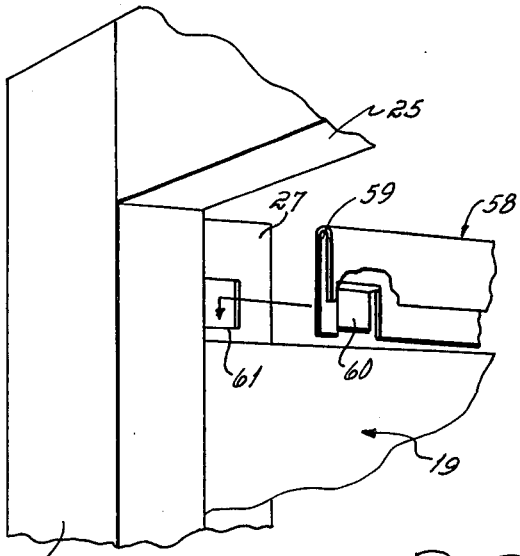
FIG. 7 is a fragmentary perspective view illustrating the mounting of the upper back plate retaining lip on the display rack.

The upper back panel 19 is fixed in place between the lower back panel retainer lip 48 and an upper back panel retainer lip 58. As best seen in FIG. 7, the upper back panel retainer lip 58 includes a downwardly and inwardly turned lip 59, and also includes a downward and outwardly turned tab 60 at each end. The upper back panel retainer lip 58 is also sized to extend between rear posts 23 of the side frames 14, 15, the tabs 60 being seated in slots 61 provided adjacent the top of those rear post flanges, thereby holding the upper back panel retainer lip in location. With the upper back panel 19 seated in the lower back panel retainer lip 48 between the lower back panel's top edge lip 57 and the retainer lip's lip 49, and with the upper back panel retainer lip 58 located so that its lip 59 embraces the upper back panel's top edge, the upper 19/lower 18 back panel structure of the display rack is assembled.

Figure 9:
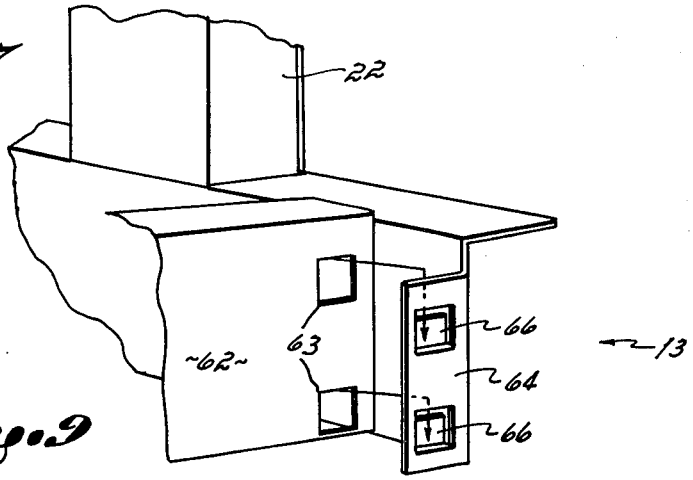
FIG. 9 is a fragmentary perspective view illustrating the securing of the foot plate to the side frames of the display rack.

A kick plate 62 is then mounted to flanges 64 at the front end of each foot cross member 26 of each side frame 14, 15. The connection is achieved by kick plate's holes 63 being seated in tabs 66 of the flanges 64 (see FIG. 9). Intermediate shelves 16 are each provided with a finger 44 at each corner thereof. As can be seen in FIG. 8, the shelves 16 are held in fixed engagement with front 22 and rear 23 posts by fingers 44 being received in post slots 24 in known fashion.

Figure 10:
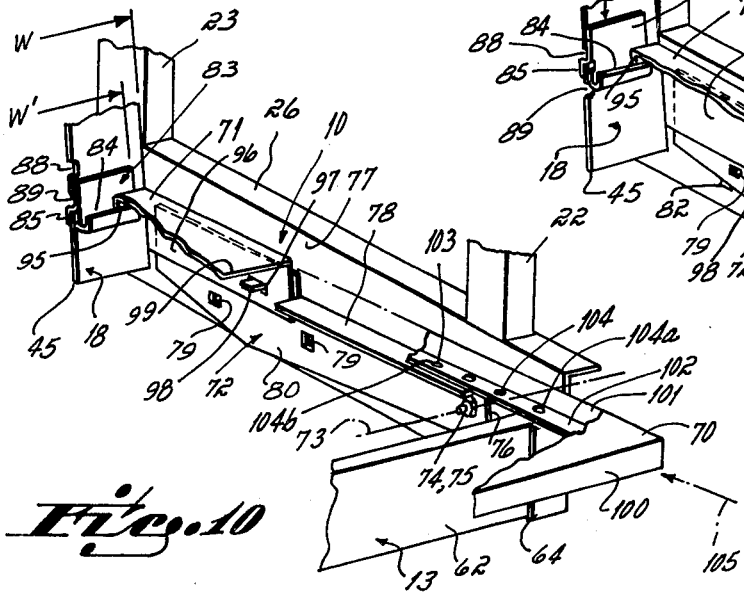
FIG. 10 is a fragmentary perspective view illustrating the novel shelf structure in an angled or slanted position relative to ground level.
Figure 11:
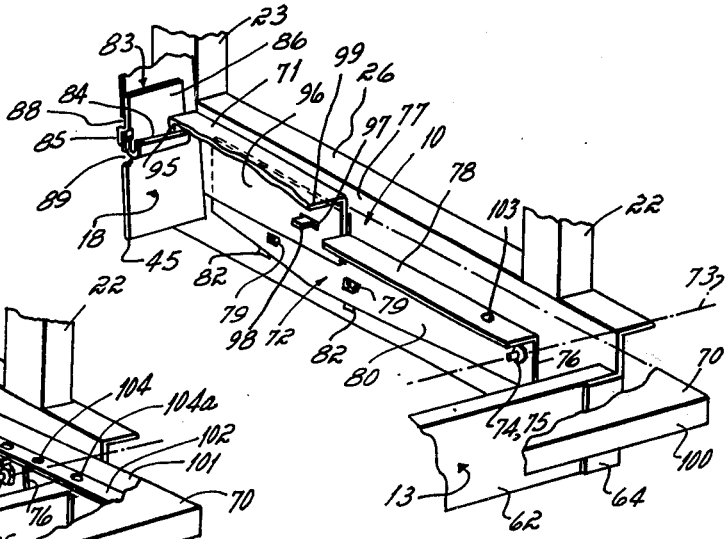
FIG. 11 is a view similar to FIG. 10 but showing the novel shelf structure in a horizontal position relative to ground level.

The novel shelf structure 10 of this invention is particularly illustrated in FIGS. 10 and 11. It will be understood that, for purposes of this invention, the foot cross members 26 of each side frame 14, 15, and the bottom portion of the lower back panel 18, in combination comprise the framework 68 for the novel shelf structure 10 of this invention. The novel shelf structure includes a front shelf section 70 panning the entire width W of the display rack 11, and a rear shelf section 71 also spanning the entire width W of the display rack. The two shelf sections 70, 71 are carried on pivotable shelf support arms 72 which interconnect with the shelf framework 68 to define pivot axis 73 adjacent the front posts 22 of the display rack 11. The novel shelf structure 10 permits the shelf 70, 71, in use, to take either a horizontal display attitude illustrated in FIG. 11 or a rearwardly and downwardly tilting display attitude illustrated in FIG. 10. The novel shelf structure 10 also permits the shelf sections 70, 71, no matter which of the horizontal or tilting shelf display attitudes is selected, to telescope relative one to the other between a fully extended attitude illustrated in solid lines in FIG. 2 and a fully retracted attitude illustrated in phantom in that same Figure. hen in assembled relation with the display rack 11, as shown in FIGS. 2 and 10, the front shelf section 70 is permitted front-to-rear movement, and the rear shelf section 71 is fixed in position against front-to-rear movement, relative to the front posts 22 to provide the telescoping extension and retraction of the shelf 10.

The shelf 70, 71 support structure, which support structure interconnects and cooperates with the rack's framework 68, is particularly illustrated in FIGS. 10 and 11. The shelf 70, 71 support structure includes the two shelf support arms 72, each being pivotally connected adjacent to the front end of the foot cross member 26 of the respective side frame 14, 15. The pivotal connection of each shelf support arm 72 is established by bolt 74 and nut 75 joinder at the arm's front end 76. Each pivotable shelf support arm 72 extends rearwardly from adjacent the display rack's front posts 22 to adjacent the rack's lower back panel 18. Note that the especially structured pivotable shelf support arms 72, which structures are not particularly aesthetically pleasing, are hidden from a casual observer's view because same are pivotally connected to the inside faces 77 of the shelf support framework's foot cross member 26.

Each pivotable shelf support arm 72 includes an inwardly turned shelf support flange or rail 78 along the top edge thereof. Also, each pivotable shelf support arm includes a pair of outwardly and downwardly turned tabs 79 in the side wall 80 of the arm. The tabs 79 are adapted to cooperate with upper 81 and lower 82 pairs of slots provided on the inside face 77 of the framework's cross member 26. The upper pair of slots 81 is positioned in the side frame's foot cross member 26 to receive and cooperate with the tabs 79 when it is desired to orient the pivotable shelf support arm 72 (and, hence, the shelf 70, 71) in a horizontal attitude, see FIG. 11. The bottom pair of slots 82 is positioned in the side frame's foot cross member 26 to cooperate with and receive the pivotable shelf support arm's tabs 79 when it is desired to orient the shelf support arm 72 (and, hence, the shelf 70, 71) in a rearwardly sloping or tilting attitude as illustrated in FIG. 10. Thus, the pivotable shelf support arm's tabs 79 and the shelf framework's slots 81, 82 cooperate to provide arm latching means operative to locate the shelf 70, 71 in either the horizontal or rearwardly tilting display attitude.

A shelf retainer lip 83, as illustrated in FIGS. 1, 10 and 11 defines an upwardly turned lip 84 along its bottom edge, the shelf retainer lip 83 being of a width W' about equal to the width of the rear shelf section 71. The shelf retainer lip 83 is provided with a plurality of rearwardly and downwardly turned tabs 85 along its back wall 86, the tabs being aligned along a common longitudinal axis 87. Note, as illustrated in FIG. 1, a series of slots 88, 89 located on upper slot line 90 and a lower slot line 91, respectively, in the lower back panel 18 adjacent the bottom edge 45 thereof. These slots 88, 89 are dimensioned, and are spaced one from the other, so as to receive the tabs 85 on the shelf retainer lip 83. This structure permits the shelf retainer lip to be disposed in an upper or horizontal shelf position (if tabs 85 are engaged with slots 88), or a lower or rearwardly tilting shelf position (if tabs 85 are engaged with slots 89), depending upon whether the upper slot line 90 or the lower slot line 91 is selected. The upper slot line 90 on the lower back panel 18 is used with the shelf retainer lip 83 when the pivotable shelf support arms 72 are latched in the upper slots 81 of the side frames' foot cross members 26. Likewise, the shelf retainer lip 83 is used with the bottom slot line 91 when the pivotable shelf support arms 72 are latched in the lower slots 82 in the side frames' foot cross members 26. Thus, there is provided multiple support points for the shelf support arms 72 and the retainer lip 83 along the three-sided shelf framework 68 upon full assembly of the display rack. The combined support arms 72 and retainer lip 83 permit the shelf 70, 71 to be supported along both side edges and its rear edge, but not along the front edge, the front edge being slightly elevated above the kick plate 62, all as described in greater detail below and as illustrated in FIGS. 10 and 11.

The rear shelf section 71 is provided with a downwardly turned flange 95 along the rear edge, and downwardly turned flanges 96 along both side edges thereof, see FIG. 10. The rear flange 95 of the rear shelf section 71 is seated in the shelf retainer lip 83 along the full length thereof, thereby fully supporting the rear shelf section along the rear edge thereof. A slot 97 in each side flange 96 receives a respective inwardly turned tab 98 on each of the pivotable shelf support arms 72 to locate and maintain the rear shelf section's front edge 99 in position relative to the shelf support arms 72.

The front shelf section 70 is provided with front 100 and side 101 flanges, see FIG. 10. The side flanges 101 carry shelf rails 102 which extend inwardly therefrom along the side flange length. The front shelf section 70 is sized width W wise so that the shelf rails 102 overlie and slide on the rails 78 defined by the pivotable shelf support arms 72 when the front shelf section is assembled with the support arms. This structure permits the front shelf section 70 to telescope relative to the rear shelf section 71. As illustrated in FIG. 10 the rear shelf section 71 is structurally interfitted with the pivotable shelf support arms 72 (through slots 97 and tabs 98) such that the article support surface of same is disposed a distance above the shelf arm's slide rails 78 that permits the front shelf section 70 to extend outwardly from underneath, and to retract inwardly beneath, the rear shelf section. The front shelf section 70 slides on the slide rails 78, 102 during telescoping movement. Note that the interaction of slide rails 78, 102 supports the front shelf section 70 along its side edges and that the front edge 99 of the rear shelf section 71 is also supported from beneath when the front shelf section 70 is at least partially telescoped therebeneath.

Note the dimple 103 provided adjacent the front end 76 of the slide rail 78 on each pivotable shelf support arm 72, see FIG. 10. The dimples 103 are adapted to cooperate with a series of holes 104 provided on the underside of the corresponding side rails 102 on the front shelf section 70. The dimples 03 and holes 104 function to locate the front shelf section 70 in the desired telescope position with the rear shelf section 71 as desired by the user.

In use, the user must first decide whether the bottom shelf 70, 71 is to be oriented in a horizontal display attitude, see FIG. 11, or in a rearwardly tilting display attitude, see FIG. 10. On the assumption that the user has decided to orient the shelf in the rearwardly tilting display attitude, the shelf retainer lip 83 is first interconnected with the lower back panel 18 in the lower line 91 of slots 89, the retainer lip's tabs 85 being received in those slots 89. Thereafter, and with the rear shelf section 71 connected between the pivotable shelf support arms 72, i.e., with shelf locater tabs 98 received in the rear shelf section's side flange slots 97, the pivotable shelf arms are pivoted downwardly about axis 73 from a previously upraised position until the support tabs 79 on each arm 72 are engaged with the lower slots 82 in each side frame's foot cross member 65. Such interengagement of each pivotable shelf arm's tabs 79 with the slots 82 in the slide frame's foot cross member 26 also locates the downwardly turned flange 95 of the rear shelf section 71 in supporting relation with the shelf retainer lip 83. This orients the shelf support structure in the rearwardly tilting display attitude. It will be understood that to locate the shelf support structure in the horizontal display attitude, the shelf retainer lip 83 is connected with the lower back panel 18 on the top slot line 90, and that each pivotable shelf support arm's tabs 79 are connected with the upper slots 81 in the respective side frame's foot cross member 26.

After the pivotable shelf support arms 72 and shelf retainer lip 83 have been positioned in the desired location, the front shelf section 70 is simply positioned on the pivotable shelf arm's slide rails 78. The front shelf section 70 may be moved along the arms' slide rails in a rear or retraction direction (see phantom arrow 105) underneath the rear shelf section 71 to the fully retracted display attitude illustrated in phantom in FIG. 2 whereat the dimple 103 on each of the pivotable shelf arm side rails is engaged with the proper or last pair of holes 104*a* in the corresponding slide rails 102 of the front shelf section (FIG. 10). On the other hand, if it is desired to have the front shelf section 70 extended outwardly from beneath the rear shelf section 71 to the maximum extent, same is only slid outwardly in a front or extension direction until the first pair of holes 104*b* on the front shelf section's slide rails 102 engage dimples 103. Of course, the fron shelf section 70 may be positioned at any intermediate location desired as permitted by the positioning of a plurality of holes 104 in the front shelf section's slide rails 102. Note that, in the fully extended position shown in FIG. 10, the front shelf section's front edge 100 extends outwardly beyond the display rack's front post 22.

Having described in detail the preferred embodiment of my invention, what I desire to claim and protect by Letters Patent is:

1. A display rack comprising opposed stationary side frames, each of said stationary frames including a front post and a rear post, said stationary frames being fixed together one to the other, a one-piece shelf support arm pivotally connected to each of said side frames, each of said shelf support arms being selectively positionable at one of a substantially horizontal display attitude and a tilting display attitude, latch means connecting each of said shelf support arms to its associated side frame for restraining said support arms in the display attitude selected, and a shelf carried on said shelf support arms, said shelf including a rear shelf section fixed in position against front-to-rear movement on said support arms when in assembled relation with said display rack, and a front shelf section carried on said support arms in a manner that permits front-to-rear movement when in assembled realtion with said display rack, said front shelf section being telescopable relative to said rear shelf section between an extended position and a retracted position for varying the merchandise support area of said shelf, the front edge of said front shelf section extending outwardly beyond said front posts at least in the extended position.

2. A display rack as set forth in claim 1, said front shelf section including a slide rail fixed thereto on each side thereof, and each of said pivotable shelf support arms including a slide rail fixed thereto, said support arm slide rails and said front shelf section slide rails cooperating one with the other to permit sliding extension and retraction of said front shelf section relative to said rear shelf section.

3. A shelf structure as set forth in claim 2 including locater means carried partially by said front shelf section and partially by at least one shelf support arm, said locater means cooperating to locate said front shelf section in the desired telescoped attitude relative to said rear shelf section during use.

4. A display rack as set forth in claim 3, said locater means including a dimple fixed to one of said support arm's rail and said front shelf section's rail, and structure defining holes in the other of said support arm's rail and said first shelf section's rail, said dimple and holes cooperating to locate said front shelf section in the desired telescoped relation relative to said rear shelf section.

5. A display rack as set forth in claim 1, said shelf support arms being pivotally connected between said side frames on a pivot axis disposed adjacent to the front face of said shelf, and said front shelf section being telescopable beneath said rear shelf section, thereby providing support to the front edge of said rear shelf section along the width of said shelf.

6. A display rack as set forth in claim 5, said display rack including a retainer lip mounted between said side frames adjacent the back edge of said rear shelf section, said retainer lip supporting the back edge of said rear shelf section along the width of said shelf.

7. A display rack as set forth in claim 6, said latch means including a plurality of tabs carried on one of said side frames and said shelf support arms, and structure defining a plurality of slots in the other of said side frames and said shelf support arms, said tabs and slots being engageable in a latching attitude to restrain said shelf support arms, and, thereby, said shelf, in the display attitude selected.

* * * * *